US007560653B1

(12) United States Patent
Sage

(10) Patent No.: US 7,560,653 B1
(45) Date of Patent: Jul. 14, 2009

(54) ELECTRICAL SWITCH NUT AND BOOT SEAL

(76) Inventor: Russell L. Sage, 905 Fortess Dr., McHenry, IL (US) 60050

( * ) Notice: Subject to any disclaimer, the term of this patent is extended or adjusted under 35 U.S.C. 154(b) by 0 days.

(21) Appl. No.: 12/069,949

(22) Filed: Feb. 14, 2008

Related U.S. Application Data

(60) Provisional application No. 60/901,936, filed on Feb. 16, 2007.

(51) Int. Cl.
*H01H 9/04* (2006.01)

(52) U.S. Cl. ..... 200/302.1; 200/302.2; 200/302.3

(58) Field of Classification Search ..... 200/296, 200/302.1, 302.2, 302.3, 333
See application file for complete search history.

(56) References Cited

U.S. PATENT DOCUMENTS

| | | | | | |
|---|---|---|---|---|---|
| 2,440,943 | A | * | 5/1948 | Gonsett et al. | 200/302.3 |
| 2,451,176 | A | * | 10/1948 | Schellman | 200/302.2 |
| 2,462,023 | A | * | 2/1949 | Johanson et al. | 403/24 |
| 2,795,144 | A | * | 6/1957 | Morse | 74/17.8 |
| 3,175,833 | A | | 3/1965 | Morse | |
| 3,316,379 | A | * | 4/1967 | Clarke et al. | 200/333 |
| 3,471,158 | A | * | 10/1969 | Solins | 277/644 |
| 4,178,806 | A | * | 12/1979 | Morse | 74/17.8 |
| 4,298,778 | A | * | 11/1981 | Beresford-Jones | 200/302.2 |
| 4,482,792 | A | | 11/1984 | Geremia | |
| 4,710,601 | A | | 12/1987 | Raab et al. | |
| 4,766,278 | A | | 8/1988 | Raab et al. | |
| 5,152,540 | A | * | 10/1992 | Kuze | 277/634 |
| 5,671,840 | A | * | 9/1997 | Glicksman | 200/302.3 |
| 5,990,430 | A | * | 11/1999 | Shiau | 200/302.2 |
| 6,720,512 | B1 | | 4/2004 | Rothbauer et al. | |
| 6,972,385 | B2 | * | 12/2005 | Krebs et al. | 200/1 B |
| 2005/0202720 | A1 | | 9/2005 | Burke et al. | |
| 2006/0018707 | A1 | | 1/2006 | Fischer et al. | |
| 2006/0148287 | A1 | | 7/2006 | Zahnen et al. | |

* cited by examiner

*Primary Examiner*—Michael A Friedhofer
(74) *Attorney, Agent, or Firm*—David A. Warmbold

(57) ABSTRACT

An improved electrical switch nut and boot seal assembly is provided having a stainless steel or aluminum nut and flexible boot to provide an exemplary fluid seal between an electrical switch and the electrical switch nut and boot seal device. The electrical switch may be a toggle switch or push button type circuit breaker or any other type electrical switch device where the advantages of the present invention make themselves useful such as may exist on any control panel of a recreational vehicle (i.e., boat, snowmobile, or other type land or water craft). A key feature of the invention is that the nut and flexible boot are separate pieces that can be mixed and matched to change the outer shape and/or colors of the various nuts and/or flexible boots. The fluid and moisture seal is provided by capturing a flange of the flexible boot between various inner surfaces of the nut and electrical switch.

20 Claims, 3 Drawing Sheets

ELECTRICAL SWITCH NUT AND BOOT SEAL

CROSS-REFERENCE TO RELATED APPLICATIONS

This application claims benefits of provisional application Ser. No. 60/901,936 filed Feb. 16, 2007 in the United States Patent and Trademark Office.

FIELD OF THE INVENTION

The present invention relates generally to the field of electrical switch sealing devices, and more particularly, to a electrical switch nut and boot seal for connecting and sealing a electrical switch to the opening in a panel through which the electrical switch projects to prevent water or any other fluid or moisture contamination from reaching the interior of the electrical switch. The present invention can be used to protect toggle switches, circuit breaker type switches or any other switch mechanisms attached to a control panel of a recreational vehicle.

BACKGROUND OF THE INVENTION

In prior art electrical switch sealing devices, it has been a primary goal to achieve a good seal about the electrical switch while at the same time allowing for easy manipulation of the electrical switch lever. In prior art electrical toggle switch devices, such as those shown in U.S. Pat. Nos. 3,175,833 and 3,420,119, utilization was made of very thin walled boot sections which were easily flexible in order to allow the toggle lever of the switch to move from one extreme position to the other position. The boot was a one piece molding which was either molded in such a fashion to slip over the nut capturing the toggle switch in place on a control panel or the boot was internally threaded to thread over the top of the nut holding the toggle switch in place. However, a problem with these prior art boots is that over time the threaded boot loosens allowing water or other contaminants to enter the opening of the toggle switch. Furthermore, these electrical switches typically have an upstanding externally threaded portion which would be positioned through a control panel such that the nut would affix the switch to a control panel. Usually the upstanding externally threaded portion of the switch has a longitudinal slot machined in the thread to provide a locating feature when installing the switch onto the control panel. And, when using a one piece molded boot, moisture can travel up this slot to reach the inside of the boot to possibly damage the internal workings of the electrical switch.

In other prior art electrical switch sealing devices the flexible boot is insert molded over a steel nut which in turn is threaded onto a toggle switch to hold it to the control panel. These prior art constructions are primarily of one piece construction using a common type of over-molding process to mold a flexible boot over the top of a metal nut, thus making them a single piece. The primary seal provided by the boot assembly is between the bottom of the one piece molded boot and nut assembly and the top of the control panel in which the toggle switch is mounted. However, this also has downfalls in that over time the boot and nut assembly can loosen from the control panel or the mold between the exterior of the nut and the flexible boot breaks down allowing water to enter either the underside of the control panel or actually into the interior of the toggle switch. Further disadvantages of the one piece over molded boot becomes apparent when a decorative nut and variable colored flexible boots are desired. In the past, such molded boot over nut options have been provided in only limited colors such as black, white or grey and since the assembly is one piece it is all one color.

Additional other designs have been provided involving sealed toggle switches such as shown in U.S. Pat. No. 4,482,792, however the switches shown therein only disclose such a switch that is internally sealed such that no water will enter the interior of the switch and does not discuss the seal between the switch and whatever panel it is attached to during its normal operation. Furthermore, U.S. Pat. No. 5,380,968 shows various protective covers for electrical switches, however the construction shown is significantly more bulky and such a construction would not work well in boating or other outdoor recreational vehicles where control panels having a multitude of switches and circuit breakers are used.

SUMMARY OF THE INVENTION

In accordance with the present invention, an improved electrical switch nut and boot seal is provided having a stainless steel or aluminum nut and flexible material boot for use to capture an electrical switch to a control panel of a recreational vehicle. A key feature of the invention is that the nut and flexible boot are separate pieces such that a plurality of nuts can be interchanged with a plurality of flexible boots. For example, in the marine industry it is desirable for the user to be able to configure a boat's control panel having both electrical switches and push button type circuit breaker switches to be able to utilize a variety of nuts with a variety of flexible boots to provide a good fluid seal between the electrical switch device and the nut and boot assembly and/or control panel to prevent fluid from entering either the electrical switch device or underneath the control panel. It is of primary importance to provide a good fluid and moisture seal and secondarily important to provide for a plurality of different colored nuts and possibly different colored flexible boots to allow the user to configure the control panel in a manner that is attractive to the user. Heretofore, the industry has only provided a limited number of options such as discussed above and further involving only a very limited matching color options to allow users to color coordinate the control panels of their boat, snowmobile, or other water or recreational vehicle. In the context of this invention, an electrical device may mean a toggle switch, push button circuit breaker type switch, key switch, or any other type electrical device where the advantages of the present invention make themselves useful.

The present invention provides for an aluminum or stainless steel nut having an undercut or groove provided therein which receives a flexible boot having a flange and domed portion extending upwardly from the flange. The flange is received within the undercut or groove portion of the nut and is captured between the bottom of the nut undercut and the top of the upstanding externally threaded portion of the electrical switch. The sealing of the switch is accomplished by the nut being tightened down on the top of the electrical switch to capture the flange of the flexible boot between the bottom of the nut's undercut area and the top of the externally threaded portion of the electrical switch. The flexible boot can be made of an injection molded TPE (thermoplastic elastomer) or rubber type material, or any other material providing sufficient flexibility to allow for operation of the switch and to provide a good seal when captured between the nut and electrical switch.

Accordingly, it is a primary object of the invention to provide an electrical switch nut and boot seal having a two part nut and flexible boot construction to allow for the interchangeability of the nut and flexible boot to allow variously colored nuts to be matched to variously colored flexible boots.

A further object of the invention is to provide an electrical switch nut and boot seal ideally useful with an electrical toggle switch type of device.

A further object of the invention is to provide an electrical switch nut and boot seal useful with a push button type circuit breaker device.

A further object of the invention is to provide an electrical switch nut and flexible boot seal useful for any recreational vehicle having a control panel that could be subject to the harsh outdoor environments including rain, snow, mud, etc.

A still further object of the invention is to provide an electrical switch nut and flexible boot seal that can be used on the existing electrical panels of recreational vehicles to allow for color coordination of the various electrical components on such panels.

These together with other objects of the invention, along with the various features of novelty that characterize the invention, are pointed out with particularity in the claims attached hereto and forming a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
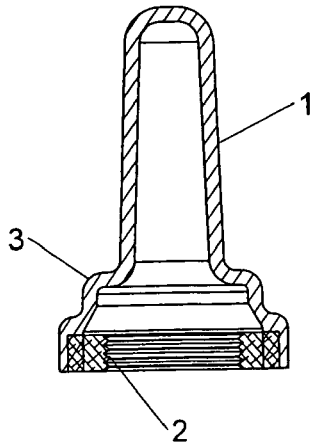
Fig 1 PRIOR ART
FIG. 1 shows a prior art electrical boot over-molded onto a nut type device which is currently being used in the industry.

Referring briefly to FIG. 1, a prior art electrical switch boot device 1 is shown. In this device a standard nut 2 is over molded with a flexible boot assembly 3 made of TPE, rubber or other flexible plastic material. The threaded nut would typically be threaded over an externally threaded portion of an electrical switch extending through a control panel of a recreational vehicle such a boat or other water craft, snowmobile, or other off road vehicle to hold the switch in place. This type of assembly has several short comings which are all discussed above.

With reference to the drawings, and in particular to FIGS. 2 through 8 thereof, a new electrical switch nut and boot seal device embodying the principles and concepts of the present invention and generally designated by the reference numeral 10 will be described.

Figure 2:
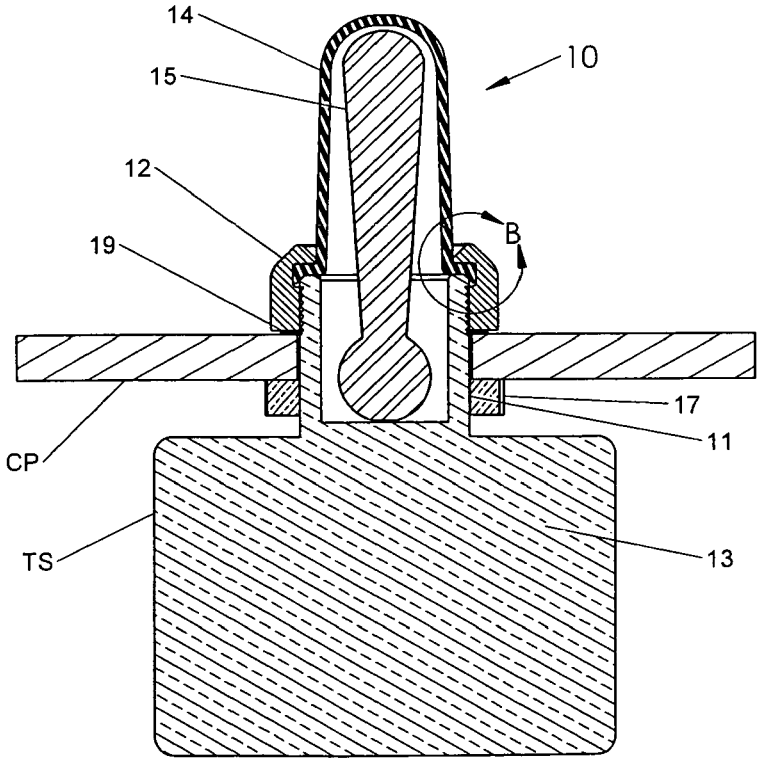
FIG. 2 shows a side view in cross section of the preferred embodiment of the present invention showing the electrical switch nut and boot seal used with a standard toggle switch.

Referring to FIG. 2, the electrical switch nut and boot seal device 10 is shown in cross section threadably received on an upstanding externally threaded portion 11 of a toggle switch TS. The toggle switch shown is typical in that it includes a body 13, an externally threaded portion 11 extending from one side, and a movable toggle switch lever 15 extending up thru the externally threaded portion of the switch. As is normally the case, a nut 17 is received about the externally threaded portion 11 to allow the user to control the height of the toggle switch lever as it extends up thru the control panel CP. The control panel CP is shown sandwiched between the electrical switch nut and boot seal device 10 and toggle switch TS. It may be desirable to place a washer 19 between the top surface of the control panel and the electrical switch nut and boot seal device 10 to prevent fluid or moisture to seep under the control panel CP.

Still referring to FIG. 2, the electrical switch nut and boot seal device 10 includes a nut element 12 and a flexible boot element 14. These elements are manufactured using techniques well known in the art such that the nut element 12 is machined from either stainless steel or aluminum, and the boot element 14 is injection molded of a TPE (thermoplastic elastomer) or rubber material such that the element 14 is sufficiently flexible to allow for repeated movement of the switch lever and to provide a good fluid and moisture seal between the nut 12 and toggle switch TS.

Figure 3:
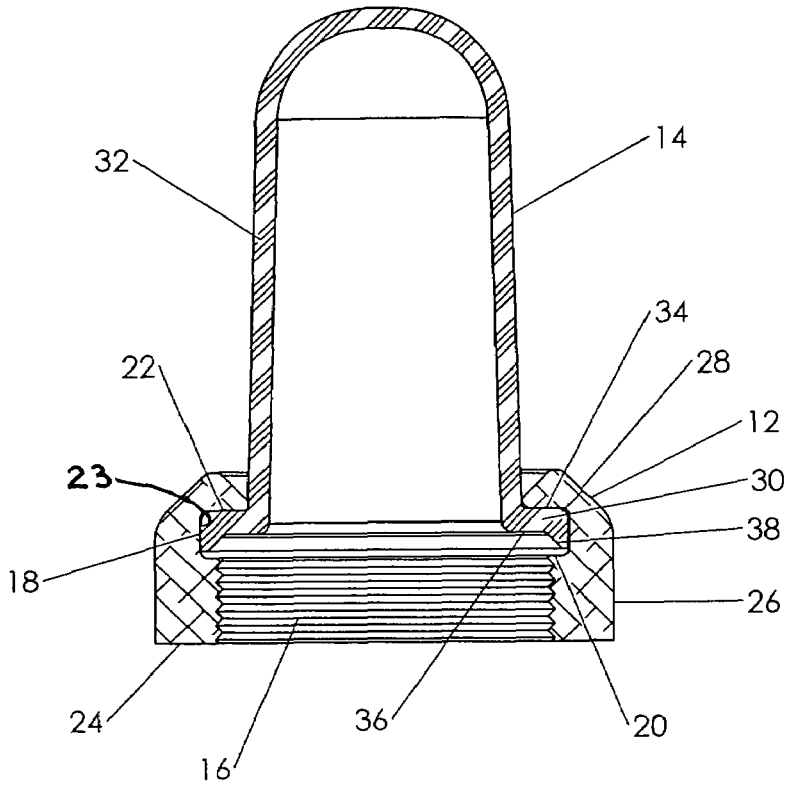
FIG. 3 shows a side cross sectional view of the electrical switch nut and flexible boot seal assembly of the present invention.

Referring to FIGS. 2 and 3, the nut element 12 is shown having a threaded longitudinal bore 16. A groove 18 is provided above the threaded bore 16 being bounded by a first (or bottom as shown in FIG. 3) planar surface 20 and second (or top) planar surface 22 and side wall 23. The nut element 12 is provided with a bottom planar surface 24 and a generally cylindrical outer surface 26. The upper side of the nut element 12 may be provided with a tapered cone section 28.

The flexible boot element 14 is shown having a flange portion 30 and an upstanding cone portion 32 which is open only towards the flange portion 30. The flange portion 30 is provided with an upper sealing surface 34, a lower planar sealing surface 36, and a tapered lip portion 38. The thickness of the tapered lip portion 38 is larger than the thickness of the flange wall between the upper sealing surface 34 and the lower sealing surface 36 for reasons discussed below in relation to FIG. 4.

Still referring to FIGS. 2 and 3, the flexible boot element 14 is shown in place within the nut element 12. The flange portion 30 is captured within the groove 18 of the nut element 12. The groove 18 of the nut element 12 captures the flange portion 30 of the boot element 14 to prevent the boot from falling out of the nut when the assembly has not yet been attached to an electrical switch device, the situation as shown in FIG. 3. The tapered lip portion 38 of flange portion 30 assists in firmly holding the flexible boot element 14 within groove 18 of the nut element 12. The material of the boot element 14 is sufficiently flexible to allow a user to manually remove the boot element 14 from the nut element 12 as is desired. The cone portion 32 extends up above the nut element 12 to enclose the toggle lever 15 of the electrical switch as shown in FIG. 2.

Referring back to FIG. 2, the electrical switch nut and flexible boot sealing device 10 is shown attached to a control panel CP and toggle switch. The electrical switch nut and boot seal device 10 is threaded onto the toggle switch such that the flexible boot element 14 encloses the toggle switch lever 15 within the cone section 32 thereof. A sealing washer 19 may be provided between the bottom nut planar surface 24 and the top of the control panel CP. In FIG. 2, the electrical switch nut and boot seal device is shown fully seated on top of the toggle switch. The details of how the electrical switch nut and boot seal device seals itself against the upstanding externally threaded portion 11 of the electrical switch are shown in section "B" of FIG. 2 and in FIG. 4, discussed below.

Figure 4:
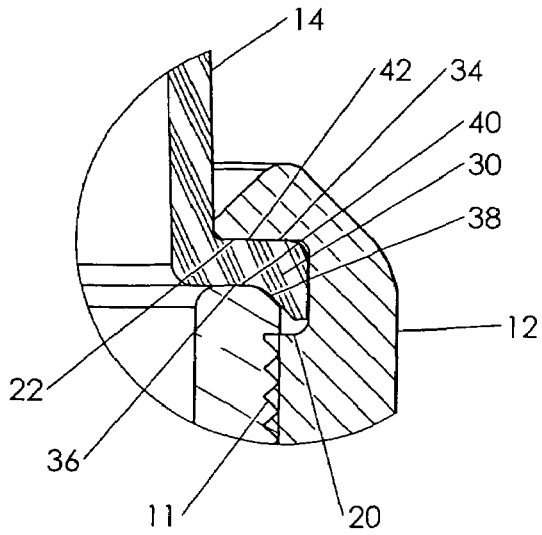
FIG. 4 shows an enlarged side cross sectional view of section "B" highlighted in FIG. 2 depicting details of the primary seal between the various components of the present invention.

Referring now to FIG. 4, when the electrical switch nut and boot seal is threadably connected to the externally threaded portion 11 of the toggle switch TS, the flange 30 of the flexible boot element 14 is shown captured between the nut element 12 and the top of the externally threaded portion 11 of the toggle switch TS. The lower sealing flange surface 36 of flange 30 is shown firmly sealed against the top of the externally threaded portion 11 of the toggle switch as shown at 40. Furthermore, the upper sealing flange surface 34 of flange 30 sealingly contacts the second (or top) planar nut surface 22 to provide a seal at 42. The tapered lip portion 38 extends around the outside of the externally threaded portion 11 of the electrical switch thus further enhancing the fluid and moisture seal between the nut element 12 and toggle switch while also providing a means of protecting against the flange 30 being pulled out of the groove 18 of the nut element 12. Since the mass and height of the material in the tapered lip portion 38 is greater than the thickness of the flange 30 between the upper and lower sealing flange surfaces 34 and 36 it is nearly impossible to pull the flange 30 of the boot element 14 out of the groove 18 of the nut element 12 when the electrical switch nut and boot seal device 10 is affixed to the top of an electrical switch, and such providing an extra measure of safety in protecting the electrical switch from fluid and/or moisture contamination. Furthermore, as discussed above in the Background of the Invention, if the externally threaded portion 11 of the electrical switch has a longitudinal slot or flat machined in it to provide an alignment means when installing the switch (not shown), the sealing flange 30 and tapered lip portion 38 would likewise prevent any fluid or moisture from traveling up this slot or flat to enter the interior of the nut and boot seal device or the interior of the electrical switch. In this manner, the electrical switch nut and boot sealing device 10 provides a good solid fluid and moisture seal between the electrical toggle switch and the electrical switch nut and boot seal device to prevent any fluids from leaking into the toggle switch.

Figure 5:
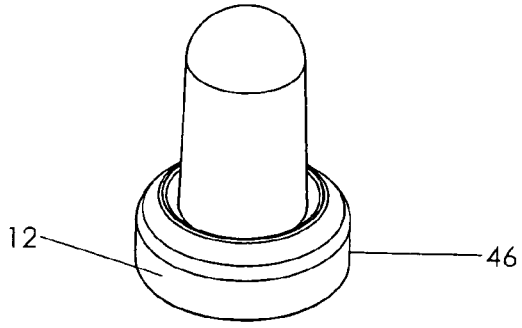
FIG. 5 shows a perspective view of the electrical switch nut and boot seal device wherein the nut is provided with a smooth circular circumference.
Figure 6:
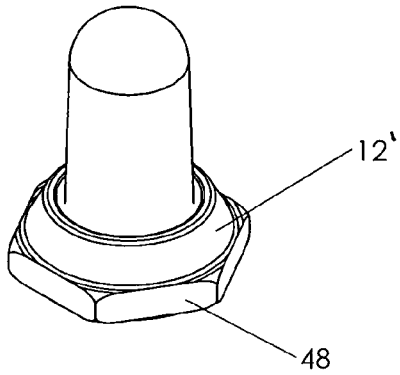
FIG. 6 shows a perspective view of the electrical switch nut and boot seal device wherein the nut is provided with a hexagonal circumference to allow for tightening with a wrench or other mechanical device.

Referring to FIG. 5, an electrical switch nut and boot sealing device 10 is shown wherein the nut element 12 has a completely circular perimeter as shown at 46. This nut is quite decorative and pleasing to the eye. Alternatively, FIG. 6 shows a nut element 12' that has a hexagonal perimeter as shown at 48. This nut allows for the easy use of a wrench to tighten the nut and boot sealing device onto the electrical switch.

Figure 7:
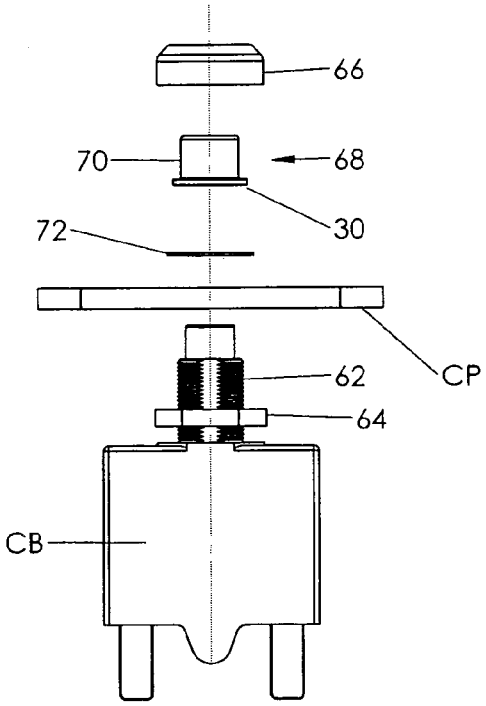
FIG. 7 shows a side exploded view of a second embodiment of the present invention wherein the electrical switch nut and boot seal device is being used with a push button type circuit breaker which is connected to a control panel.
Figure 8:
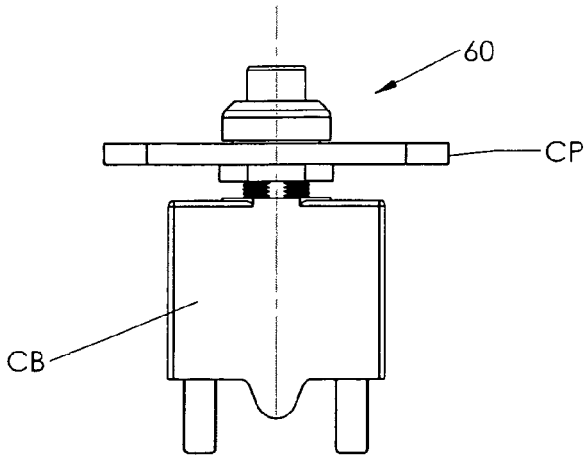
FIG. 8 shows a side cross sectional view of the second embodiment of the present invention showing the electrical switch nut and boot seal device attached to the push button type circuit breaker switch which is connected to a control panel.

Referring to FIGS. 7 and 8, an alternate embodiment is shown wherein an electrical switch nut and boot seal device 60 is being used with a control panel CP and an push button type circuit breaker CB. This type of circuit breaker is commonly used in recreational vehicles such as water craft, snowmobiles and other off road vehicles. As similarly discussed above, the circuit breaker CB has an upstanding externally threaded portion 62 and nut 64 threaded thereon to limit how much of the threaded portion 62 extends above the control panel CP. A push button switch (not shown) which when tripped would extend out above the externally threaded portion 62. The nut and boot seal device 60 has a nut element 66 having a groove 18 and first and second planar surfaces 20 and 22 all as discussed above in relation to FIGS. 3 and 4. A flexible boot element 68 is provided having a boot flange 30 with an upper sealing surface 34, lower sealing surface 36, and lip portion 38, all as discussed above in relation to FIG. 4. The boot element 68 has a cone portion 70 which is configured slightly differently than the cone portion 32 of the first embodiment due to the different shape of the circuit breaker button and toggle switch lever. The boot element flange 30 of boot 68 is positioned within the groove 18 of nut element 66 in a similar fashion to that described in the first embodiment and as shown in FIG. 4. A sealing washer 72 is shown positioned between the bottom of the nut element 66 and the control panel CP to prevent fluid leakage between the control panel and externally threaded portion 62 of the circuit breaker CP. Furthermore, the cone portion 70 can be similarly configured as shown in FIGS. 5 and 6 as described above.

The present invention provides a novel approach to electrical switch nut and boot seal devices over the prior art in that the nut elements 12 and 66 and flexible boot elements 14 and 68 can all be different colored so that the user can color coordinate the control panel of the recreational vehicle to have one or more colored nut elements to be used with one or more colored flexible boot elements. Or all the nut elements could be one color and the boot elements being one or more different colors, all in complete control of the user. For example, the nut elements can be stainless steel, or powder coated aluminum (in colors red, purple, blue, yellow, green, gold or any other color) and the boot elements can or a colored TPE or rubber material (i.e., black, white, grey, red, blue, yellow, green, or any other color) to be mixed and matched as seen fit by the user.

Numerous modifications and adaptations of the present invention will be apparent to those skilled in the art and thus, it is intended by the following claims to cover all such modifications and adaptations which fall within the true spirit and scope of the invention.

What is claimed is:

1. An electrical switch nut and boot seal device for use with an electrical switch having an externally threaded portion extending away from the body of the switch with a manual manipulation switch portion extending through the externally threaded portion exteriorly to the switch and a control panel having a hole receiving such externally threaded switch portion, the electrical switch nut and boot seal device comprising:

a nut having a longitudinal bore with an internal thread portion and an internal groove adjacent the internal thread portion;

a flexible boot having a flange portion and a cone portion extending away from the such flange portion, the flange portion being captured by the internal groove of the nut; and the nut being threadable over the externally threaded portion of said electrical switch such that the flexible boot encapsulates the manual manipulation switch portion thereof effectively sealing the interior of the electrical switch from fluid contamination.

2. An electrical switch nut and boot seal device according to claim 1, wherein the manual manipulation switch portion is a toggle switch.

3. An electrical switch nut and boot seal device according to claim 1, wherein the manual manipulation switch portion is a circuit breaker button.

4. An electrical switch nut and boot seal device according to claim 1, wherein the manual manipulation switch portion is a key switch.

5. An electrical switch nut and boot seal device according to claim 1, wherein the internal groove of the nut is bounded by generally parallel side walls connected by an end wall, and the flange portion of the flexible boot has a radially extending portion and a tapered lip portion extending below the radially extending portion, the tapered lip portion having a greater thickness than the radially extending portion, the radially extending portion and tapered lip portion of said flange portion being captured within the internal groove of the nut.

6. An electrical switch nut and boot seal device according to claim 5, wherein when the nut is threadably received about the externally threaded portion of the electrical switch, a fluid seal is maintained therebetween by the flange portion of the flexible boot being sandwiched between the externally threaded portion and a side wall of the internal groove of the nut, the tapered lip portion of the flange portion extending around and about the top and portion of the side of the externally threaded portion to further enhance the fluid seal between the nut and the electrical switch and to prevent the possibility of the flange portion of the flexible boot being pulled out of the internal groove of the nut during normal operation of the manual manipulation switch portion of the electrical switch.

7. An electrical switch nut and boot seal device according to claim 1, wherein the nut is manufactured out of stainless steel and the flexible boot is manufactured out of a thermoplastic or rubber material and is provided to the user in a multitude of different colors such that the different colored flexible boots can be mixed and matched with the stainless steel nut.

8. An electrical switch nut and boot seal device according to claim 1, wherein the nut is manufactured out of a powdered aluminum and the flexible boot is manufactured out of a thermoplastic or rubber material, the powdered aluminum and flexible boots being provided to the user in a multitude of different colors such that the different colored flexible boots can be mixed and matched with the different colored powdered aluminum nuts.

9. An electrical switch nut and boot seal device according to claim 1, further comprising a sealing washer being provided about the externally threaded portion of the electrical switch and sandwiched between the top of the control panel and the bottom of the nut to provide a fluid and moisture seal therebetween.

10. An electrical switch nut and boot seal device for use with an electrical switch having an externally threaded portion extending away from the body of the switch with a manual manipulation switch portion extending through the externally threaded portion exteriorly to the switch, the electrical switch nut and boot seal device comprising:

a nut having a longitudinal bore with an internal thread portion and an internal groove adjacent the internal thread portion, the internal groove having at least one planar wall surface facing toward the internal thread portion;

a flexible boot having a flange portion and a cone portion extending away from the such flange portion, the flange portion being captured by the internal groove of the nut; and the nut being threadable over the externally threaded portion of said electrical switch such that the cone of the flexible boot encapsulates the manual manipulation switch portion and the flexible boot flange portion being sandwiched between the top of the externally threaded portion of the electrical switch and the planar wall surface of the nut to provide a fluid and moisture seal therebetween.

11. An electrical switch nut and boot seal device according to claim 10, wherein the internal groove of the nut is bounded by generally parallel planar wall surfaces connected by an end wall, and the flange portion of the flexible boot having a radially extending portion and a tapered lip portion extending radially outwardly and below the radially extending portion, the tapered lip portion having a greater thickness than the radially extending portion, the radially extending portion and tapered lip portion of said flange portion being captured within the internal groove of the nut.

12. An electrical switch nut and boot seal device according to claim 11, wherein when the nut is threadably received about the externally threaded portion of the electrical switch, a fluid seal is maintained therebetween by the flange portion of the flexible boot being sandwiched between the externally threaded portion and the planar wall surface of the internal groove of the nut, the tapered lip portion of the flange portion extending around and about the top and portion of the side of the externally threaded portion to further enhance the fluid seal between the nut and the electrical switch and to prevent the possibility of the flange portion of the flexible boot being pulled out of the internal groove of the nut during normal operation of the manual manipulation portion of the electrical switch.

13. An electrical switch nut and boot seal device according to claim 10, wherein the externally threaded portion of the electrical switch is passed through a hole provided in a control panel of a recreational vehicle, the nut and boot seal device affixing the electrical switch to the control panel and further comprising a washer provided about the externally threaded portion of the electrical switch, the washer being sandwiched between the control panel and the bottom of the electrical switch nut and boot seal device to provide a fluid and moisture seal therebetween such that no fluid or moisture can seep either into the interior of the electric switch or underneath the control panel.

14. An electrical switch nut and boot seal device according to claim 10, wherein the manual manipulation switch portion is a toggle switch.

15. An electrical switch nut and boot seal device according to claim 10, wherein the manual manipulation switch portion is a circuit breaker button.

16. An electrical switch nut and boot seal device according to claim 10, wherein the manual manipulation switch portion is a key switch.

17. An electrical switch nut and boot seal device according to claim 10, wherein the nut is manufactured out of stainless steel and the flexible boot is manufactured out of a thermoplastic or rubber material and is provided to the user in a multitude of different colors such that the different colored flexible boots can be mixed and matched with the stainless steel nut.

18. An electrical switch nut and boot seal device according to claim 10, wherein the nut is manufactured out of a powdered aluminum and the flexible boot is manufactured out of a thermoplastic or rubber material, the powdered aluminum and flexible boots being provided to the user in a multitude of different colors such that the different colored flexible boots can be mixed and matched with the different colored powdered aluminum nuts.

19. An electrical switch nut and boot seal device for use with an electrical switch having an externally threaded portion extending away from the body of the switch with a manual manipulation switch portion extending through the externally threaded portion exteriorly to the switch and a control panel having a hole receiving such externally threaded switch portion, the electrical switch nut and boot seal device comprising:

a nut having a longitudinal bore with an internal thread portion and an internal groove adjacent the internal thread portion, the internal groove being bounded by generally parallel planar wall surfaces connected by an end wall;

a flexible boot having a flange portion and a cone portion extending away from the such flange portion, the flange portion having a radially extending portion and a tapered lip portion extending radially outwardly and below the radially extending portion, the tapered lip portion having a greater thickness than the radially extending portion, the radially extending portion and tapered lip portion of said flange portion being captured within the internal groove of the nut; and the nut being threadable over the externally threaded portion of said electrical switch such that the cone of the flexible boot encapsulates the manual manipulation switch portion and the flexible boot flange portion being sandwiched between the top of the externally threaded portion of the electrical switch and the planar wall surface of the nut to provide a fluid and moisture seal therebetween.

20. An electrical switch nut and boot seal device according to claim 19, wherein when the nut is threadably received about the externally threaded portion of the electrical switch, a fluid seal is maintained therebetween by the flange portion of the flexible boot being sandwiched between the externally threaded portion and the planar wall surface of the internal groove of the nut, the tapered lip portion of the flange portion extending around and about the top and portion of the side of the externally threaded portion to further enhance the fluid seal between the nut and the electrical switch and to further prevent the possibility of the flange portion of the flexible boot being pulled out of the internal groove of the nut during normal operation of the manual manipulation portion of the electrical switch.

* * * * *